US008359881B2

(12) United States Patent
Junge et al.

(10) Patent No.: US 8,359,881 B2
(45) Date of Patent: Jan. 29, 2013

(54) REFRIGERATOR APPLIANCE WITH FREEZER COMPARTMENT POSITION-ADJUSTABLE PARTITIONS

(75) Inventors: Brent Alden Junge, Evansville, IN (US); William Arnold Brown, Jr., Louisville, KY (US); John Simpson, Owensboro, KY (US)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 13/004,420

(22) Filed: Jan. 11, 2011

(65) Prior Publication Data

US 2012/0047939 A1 Mar. 1, 2012

(51) Int. Cl.
*F25D 25/00* (2006.01)

(52) U.S. Cl. ..... 62/465; 62/440

(58) Field of Classification Search ..... 62/382, 62/465, 440, 448

See application file for complete search history.

(56) References Cited

U.S. PATENT DOCUMENTS

| | | | | |
|---|---|---|---|---|
| 4,009,590 | A * | 3/1977 | Webb et al. | 62/180 |
| 5,355,686 | A * | 10/1994 | Weiss | 62/89 |
| 5,551,192 | A | 9/1996 | Avendano et al. | |
| 7,490,915 | B2 | 2/2009 | O'Halloran et al. | |
| 7,665,814 | B2 | 2/2010 | Laible | |
| 7,685,837 | B2 | 3/2010 | Ritchie et al. | |

FOREIGN PATENT DOCUMENTS

| | | | |
|---|---|---|---|
| CN | 201081495 | Y | 7/2008 |
| FR | 2788844 | A1 | 7/2000 |

* cited by examiner

*Primary Examiner* — Melvin Jones
(74) *Attorney, Agent, or Firm* — Global Patent Operation; Douglas D. Zhang

(57) ABSTRACT

A refrigerator appliance includes a freezer compartment and at least one position-adjustable partition located in the freezer compartment. The at least one position-adjustable partition is configured to be selectively deployed in a first position such that a space is defined in the freezer compartment that causes a reduction in an amount of inlet airflow that contacts one or more portions of the freezer compartment that are outside the defined space.

18 Claims, 8 Drawing Sheets

REFRIGERATOR APPLIANCE WITH FREEZER COMPARTMENT POSITION-ADJUSTABLE PARTITIONS

BACKGROUND OF THE INVENTION

The subject matter disclosed herein relates to refrigerator appliances, and more particularly to increasing energy efficiency in such refrigerator appliances.

It is known that new government regulations, as well as consumer demand, have been significant catalysts behind the development of low energy use appliances. It is generally realized that low energy use appliances can be developed by improving upon existing appliances that suffer from specific forms of energy inefficiencies.

Take, for example, a typical refrigerator appliance wherein a fan circulates air from the enclosed compartment being cooled (e.g., freezer compartment) across coils or tubes of an evaporator. The evaporator carries a cold refrigerant liquid and vapor mixture. The warm air from the enclosed compartment passing over the coils/tubes evaporates the liquid part of the cold refrigerant mixture. At the same time, the circulating air is cooled and thus lowers the temperature of the enclosed compartment to a desired temperature.

However, it is realized that when the cooled air contacts the side walls and door gaskets of the enclosed compartment, this increases heat leakage and energy usage. Such increased heat leakage and energy usage lowers the overall energy efficiency of the refrigerator appliance.

BRIEF DESCRIPTION OF THE INVENTION

As described herein, the exemplary embodiments of the present invention overcome one or more disadvantages known in the art.

One aspect of the present invention relates to a refrigerator appliance comprising a freezer compartment and at least one position-adjustable partition located in the freezer compartment. The at least one position-adjustable partition is configured to be selectively deployed in a first position such that a space is defined in the freezer compartment that causes a reduction in an amount of inlet airflow that contacts one or more portions of the freezer compartment that are outside the defined space.

The one or more portions of the freezer compartment that are outside the defined space may comprise one or more sidewalls of the freezer compartment. Further, the one or more portions may comprise one or more gasket portions of the freezer compartment.

The refrigerator appliance may further comprise another position-adjustable partition wherein the one position-adjustable partition and the other partition-adjustable partition form a pair of partitions. When both partitions are selectively deployed in the first position, the pair of partitions defines the space.

Still further, the one position-adjustable partition and the other partition-adjustable partition may be further configured to be selectively deployed in a second position such that the amount of inlet airflow contacting the one or more portions of the freezer compartment outside the defined space is not substantially reduced.

Another aspect of the present invention relates to an apparatus comprising at least one position-adjustable partition for use in a freezer compartment of a refrigerator appliance, wherein the at least one position-adjustable partition is configured to be selectively deployed in a first position in the freezer compartment such that a space is defined in the freezer compartment that causes a reduction in an amount of inlet airflow that contacts one or more portions of the freezer compartment that are outside the defined space.

Advantageously, illustrative apparatus and methods of the present invention provide for one or more partitions designed to force the cold air from the evaporator to cool the frozen food that is placed on the freezer shelves while lowering the velocity and raising the temperature of the air that reaches the side walls and portions of the door gasket. Cold air that flows over the center of the freezer compartment (as defined by the partitions) decreases the energy usage of the refrigerator by allowing for lower heat leakage while maintaining desired compartment temperatures.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of a refrigerator appliance such as a household refrigerator. However, it is to be understood that methods and apparatus of the invention are not intended to be limited to use in household refrigerators. Rather, methods and apparatus of the invention may be applied to and deployed in any other suitable refrigeration environments in which it would be desirable to improve energy efficiency.

Figure 1:
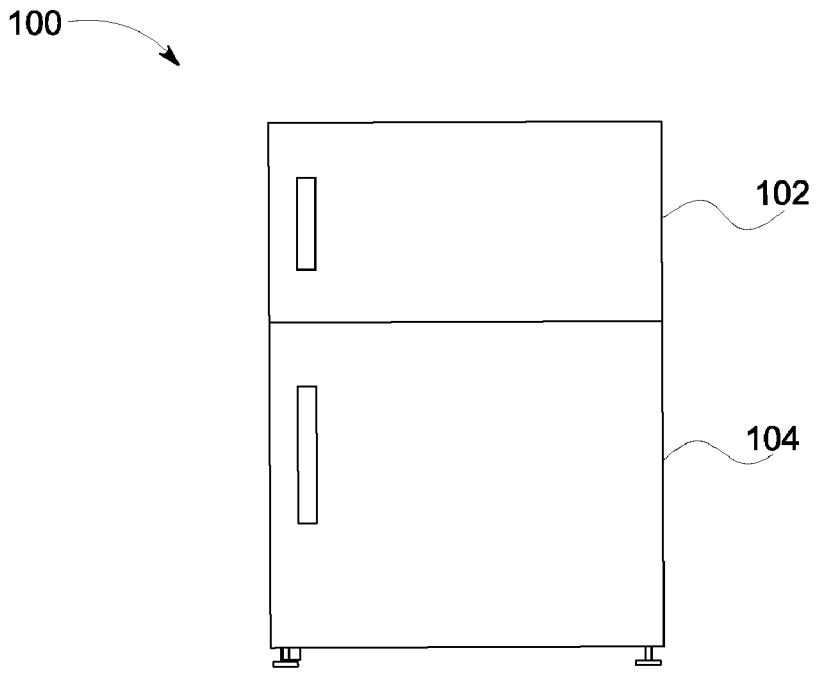
FIG. 1 is a diagram of a refrigerator appliance, in accordance with one embodiment of the invention.

FIG. 1 illustrates an exemplary refrigerator appliance 100 within which embodiments of the invention may be implemented. As is typical, a refrigerator has a freezer compartment 102 and a fresh food compartment 104. The fresh food compartment typically maintains foods and products stored therein at temperatures at or around about 40 degrees Fahrenheit in order to preserve the items therein, and the freezer compartment typically maintains foods and products at temperatures below about 32 degrees Fahrenheit in order to freeze the items therein.

While the exemplary refrigerator 100 in FIG. 1 illustrates the freezer compartment 102 and the fresh food compartment 104 in a top-mount configuration, i.e., the freezer compartment is on top of the fresh food compartment, it is to be understood that other configurations are known, such as side-by-side configurations where the freezer compartment is situated on one side of the fresh food compartment. Embodiments of the invention can be implemented in such side-by-side configurations as well.

Figure 2:
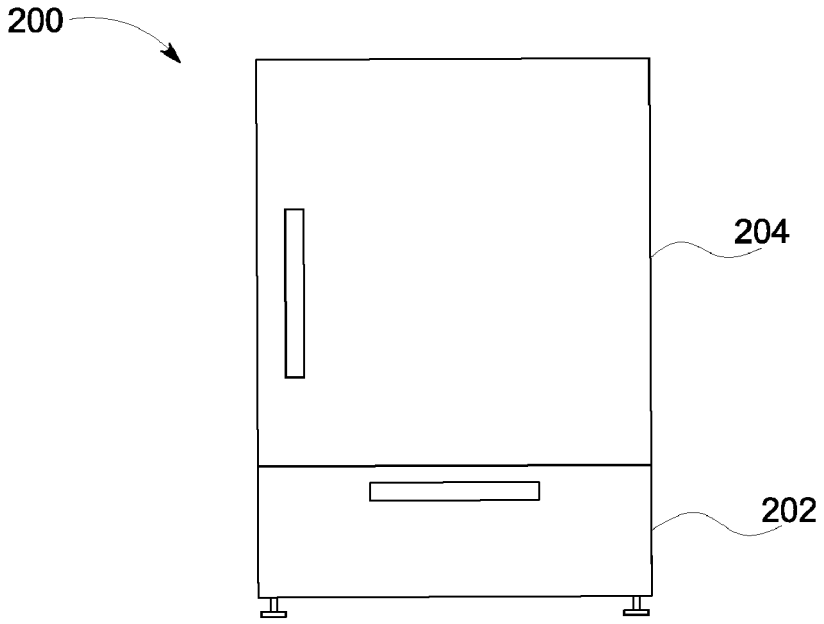
FIG. 2 is a diagram of a refrigerator appliance, in accordance with another embodiment of the invention.

FIG. 2 illustrates a refrigerator appliance 200 within which embodiments of the invention may also be implemented. FIG. 2 is a bottom-mount configuration where a freezer compartment 202 is situated below a fresh food compartment 204.

It is to be appreciated that embodiments of the invention may be implemented in the refrigerator 100 of FIG. 1 or the refrigerator 200 of FIG. 2. However, methods and apparatus of the invention are not intended to be limited to implementation in refrigerators such as the ones depicted in FIGS. 1 and 2. That is, the inventive methods and apparatus may be implemented in other household refrigerator appliances, as well as non-household (e.g., commercial) refrigerator appliances. Furthermore, such inventive methods and apparatus may be generally implemented in any appropriate refrigeration system.

As mentioned above, in the freezer compartment of a refrigerator, when the cooled air contacts the side walls and door gasket of the freezer compartment, heat leakage and energy usage increases. Such increased heat leakage and energy usage lowers the overall energy efficiency of the refrigerator.

To overcome this and other problems with existing refrigerator appliances, principles of the invention provide an improved refrigeration system which uses one or more position-adjustable partitions that provide for cold air from the evaporator to be captured and held in the space defined by the partitions where most of the food load is preferably placed. These partitions can be used as a convenient place to store food for quick freezing. In one embodiment, the air is allowed to escape through a lower shelf to then return to the evaporator. Advantageously, these partitions funnel the coldest air to the center of the compartment where the food load is preferably stored and provides for warmer and lower velocity air in the high heat leakage regions of the gasket and side walls.

FIGS. 3-7 are diagrams illustrating views of a top-mount freezer compartment 300 with position-adjustable partitions, in accordance with one embodiment of the invention. Recall that FIG. 1 illustrates a refrigerator appliance 100 with a top-mount freezer compartment. Top-mount freezer compartment 300 can be used in refrigerator appliance 100.

It is to be understood that FIGS. 3-7 show front views of a top-mount freezer compartment 300 in which a pair of position-adjustable partitions is installed. In the illustrative embodiment depicted in FIGS. 3-7, the partitions are considered "flip up" partitions because, as will be explained, the partitions which initially are resting toward the bottom of the freezer compartment 300 are flipped from a horizontal position to a vertical (upright) position when deployed. The vertical positioning of the partitions defines a space that causes a reduction in an amount of inlet airflow that contacts one or more portions of the freezer compartment that are outside the defined space.

However, it is to be understood that the flip up arrangement is only one illustrative embodiment. That is, the partitions could be deployed in other arrangements, for example, a "flip down" arrangement where the partitions initially rest in a non-deployed position toward the top of the freezer compartment 300 (on ceiling of compartment), and are flipped down to create the defined space. One of ordinary skill in the art will appreciate alternative arrangements for the partitions given the inventive teachings described herein.

Thus, as shown, the generally rectangular-shaped freezer compartment 300 is defined by a rear wall 302, a pair of side walls 304, floor 306, ceiling 308, and the freezer door (not shown). It is to be understood that the freezer door is in the opened position for the views shown in FIG. 3-7 but would be parallel to rear wall 302 when in the closed position.

Also shown in freezer compartment 300 are a shelf 310, an evaporator airflow return 312, and an evaporator airflow inlet 314. Position-adjustable partitions 316 and 318 are attached to the shelf 310. In this embodiment, the position-adjustable partitions 316 and 318 are each attached to the shelf 310 via two clips 319 (one toward the front of the partition and one toward the back of the partition). Such clips may be formed in a variety of ways known to those ordinarily skilled in the art but are generally formed to allow the partitions to be flipped up to a vertical position and flipped back down to a horizontal position by a user of the refrigerator appliance. The clips 319 may be formed to allow the user to removably attach (detach and re-attach) the partitions 316 and 318 on the shelf 310 so that the partitions can be moved along the length of the shelf (increasing or decreasing the space between the partitions when in the vertical position), or removed completely. In another embodiment, the clips 319 could be formed so that the partitions 316 and 318 are not readily removable.

Figure 3:
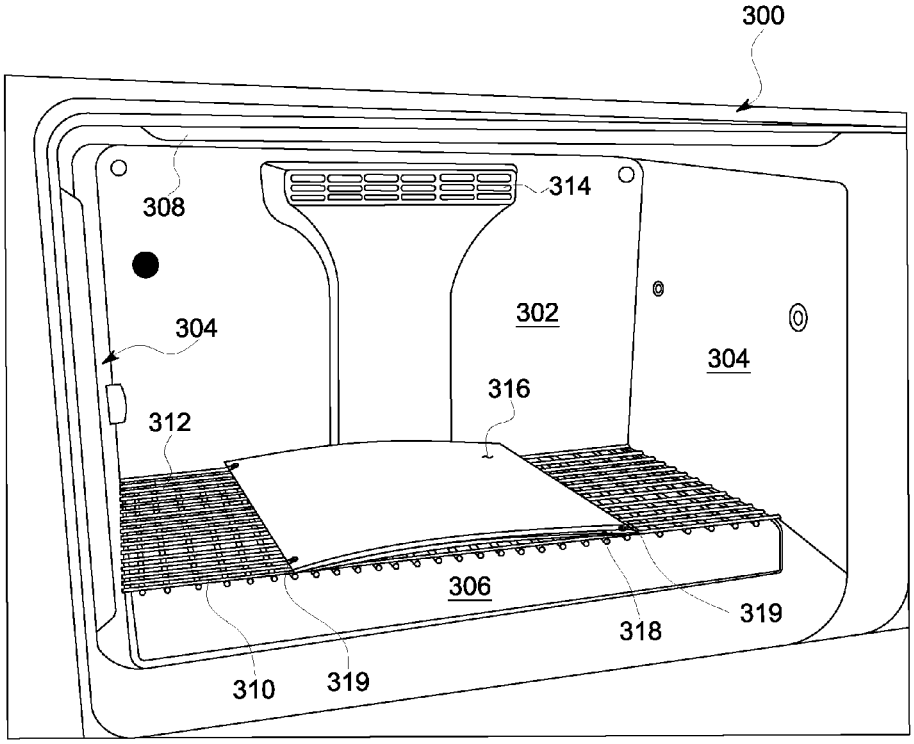
FIGS. 3-7 are diagrams illustrating views of a top-mount freezer compartment with position-adjustable partitions, in accordance with one embodiment of the invention.

FIG. 3 shows both partitions 316 and 318 in a horizontal position. In this position, one partition is laying on top of the other partition so that they rest substantially flat on the shelf 310. Accordingly, food and other items to be frozen in the freezer compartment 300 can be stacked on top of the partitions as if no partitions were present in the freezer compartment. It is to be understood that the dimensions of the partitions are dependent on the dimensions of the freezer compartment. Further, it is to be realized that the partitions may be located at such a distance from one another that, when they are resting in the horizontal position, they do not overlap one another.

Figure 4:
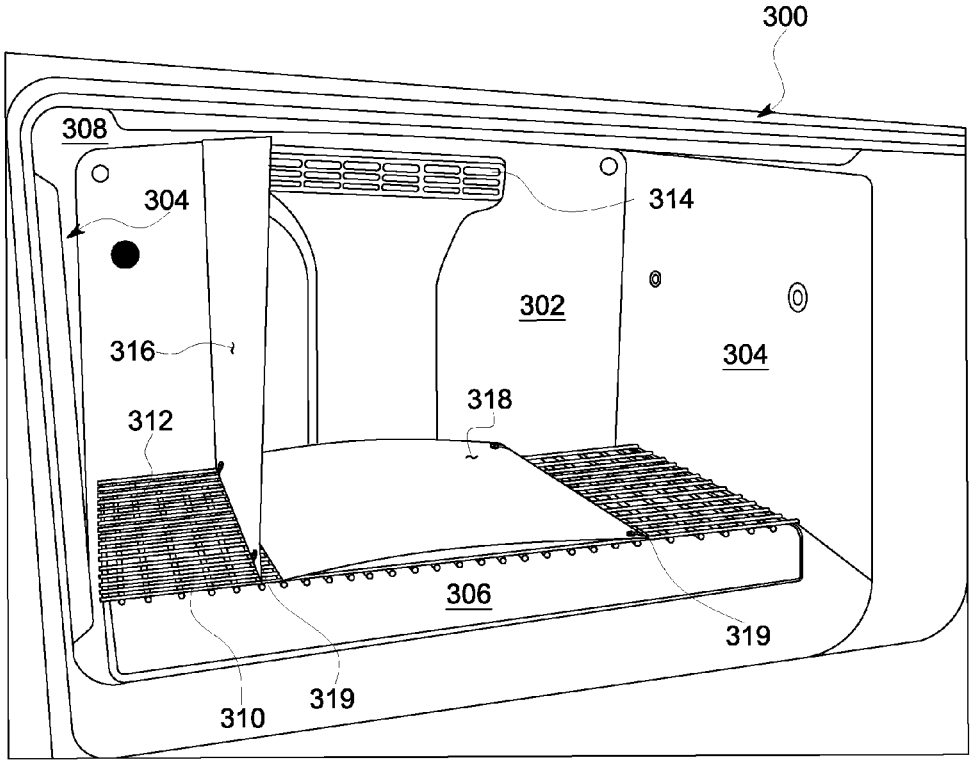
Figure 5:
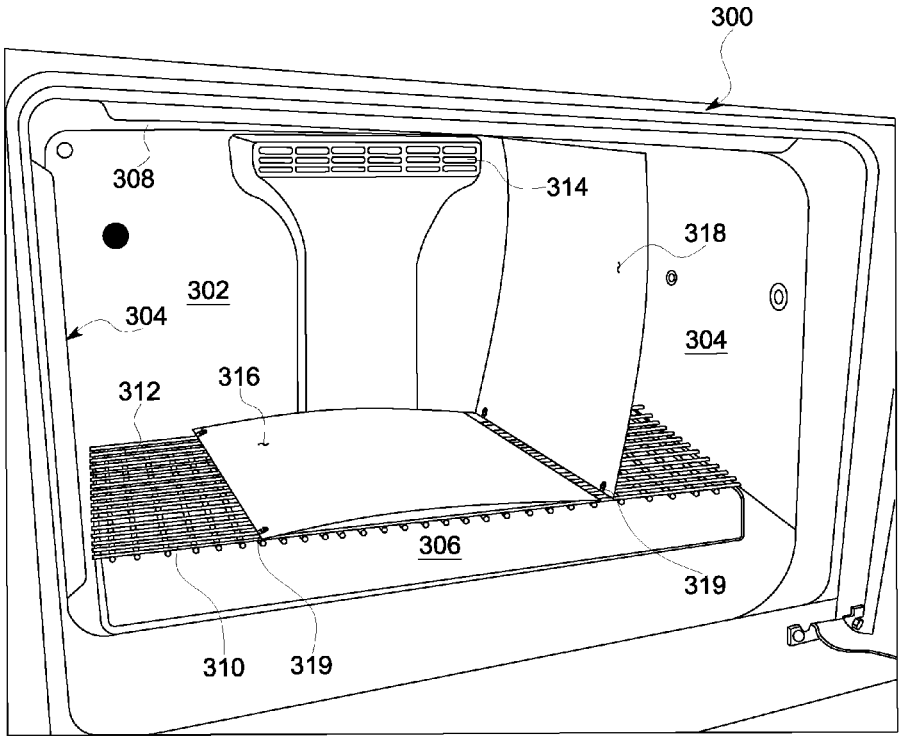

FIG. 4 shows partition 316 in the vertical position and partition 318 in the horizontal position. Conversely, FIG. 5 shows partition 316 in the horizontal position and partition 318 in the vertical position. It is to be understood that the partitions can be maintained in a vertical position in any variety of ways. For example, clips 319 may be so formed as to have a locking mechanism that keeps the partition upright and stable when moved to the vertical position by the user, but that easily releases when the user decides to return the partition to a horizontal position. Alternatively, one or more attachable clips (not shown) can be mounted on the ceiling 308 of the freezer compartment, such ceiling clips engaging the top of the partition and holding it in the upright position.

In another embodiment, each partition can include one or more short legs (e.g., approximately one inch protrusions or attachments) formed on each partition near the bottom at about 90 degrees to the rear wall 302. When the partition is flipped up, the one or more legs contact the shelf 310 and keep the partition from going beyond vertical. It is to be appreciated that such legs and locking clips mentioned herein are examples of position holding features formed in or on the partitions. Furthermore, the shelf 310 could also have a feature formed therein or thereon that cooperatively holds the partition in the vertical position.

Figure 6:
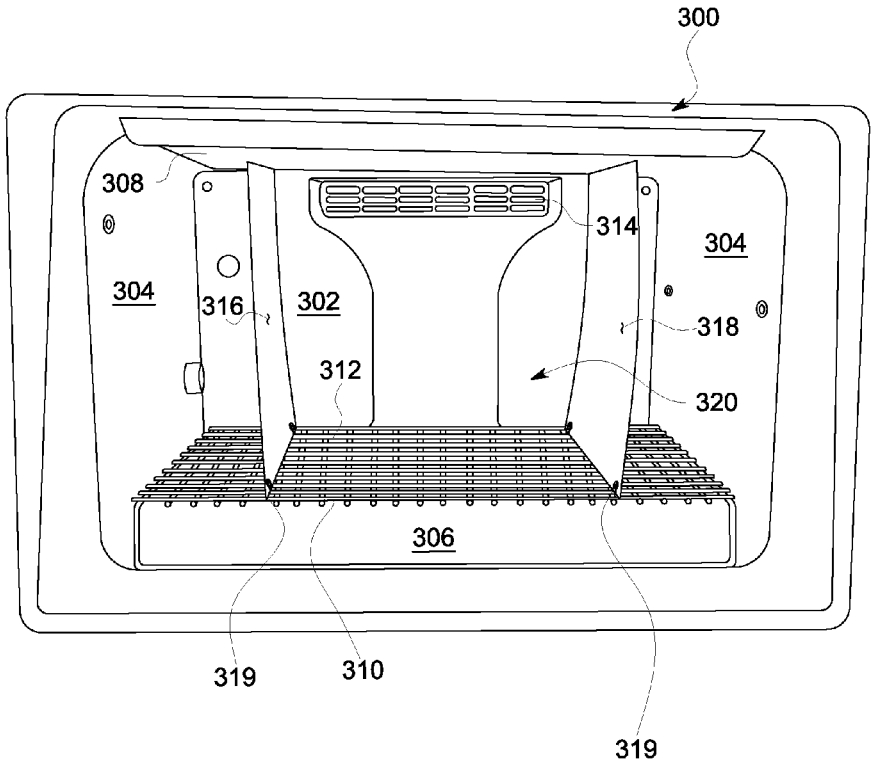
Figure 7:
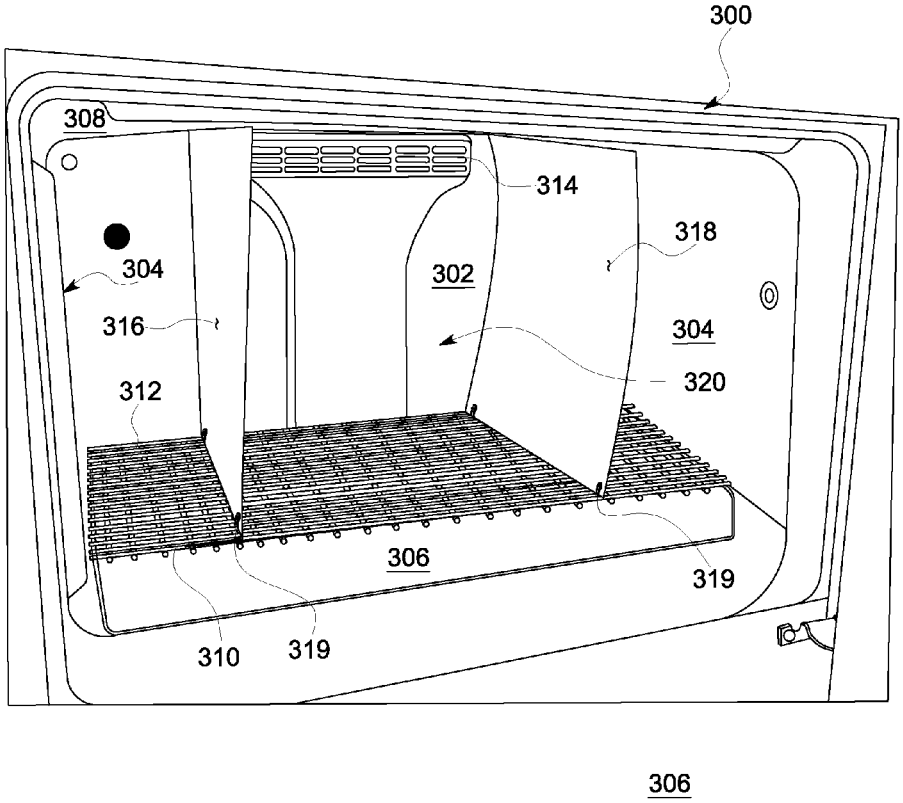

FIGS. 6 and 7 show both partitions 316 and 318 in the vertical position. Note that the partitions 316 and 318, in conjunction with rear wall 302, ceiling 308, shelf 310 and the freezer door (in a closed position), define a space 320. Note also that the defined space 320 is formed such that the evaporator airflow inlet 314 is located within the defined space 320. Preferably, the defined space 320 is where the food and items that the user desires to keep at the coldest temperature are placed.

In operation, cooled air from the evaporator (not shown) enters the freezer compartment through the evaporator airflow inlet 314. Advantageously, by virtue of the partitions 316 and 318 being deployed in the vertical position, the cooled air passing through the airflow inlet 314 is substantially captured and held in the defined space 320 where, as mentioned above, most of the food load is preferably placed. Thus, since the partitions cause the coldest air to be funneled to the defined space 320, i.e., the center of the freezer compartment 300, the defined space 320 is used as a convenient place to store food for quick freezing. The air is allowed to escape the defined space 320 through the shelf 310 (which is grated). The air then flows through vents of the evaporator airflow return 312 (below the shelf 310) and returns to the evaporator.

Furthermore, since the majority of the air coming from the evaporator is captured in the defined space 320, this causes a reduction in the amount of airflow that contacts one or more portions of the freezer compartment 300 that are outside the defined space 320. Recall that the side walls 304 and freezer door gasket (not shown) are considered high heat leakage regions and thus would be considered portions of the freezer compartment that are outside the defined space 320. Therefore, the majority of the coldest air entering the freezer compartment is substantially blocked by the partitions 316 and 318 such that warmer and lower velocity air is provided to these high heat leakage regions.

It is to be understood that while a pair of position-adjustable partitions are shown in FIGS. 3-7, one or more advantages of the invention can be realized with only one partition deployed in a vertical position, or even one partition installed in the freezer compartment. That is, with one partition in the vertical position, such as shown in FIGS. 5 and 6, the space wherein the cooled airflow from the evaporator inlet is captured would be the space defined by the one partition and one of the side walls 304. Thus, in such an arrangement, the partition reduces the amount of cool air that contacts the other side wall and corresponding portions of the door gasket.

Figure 8:
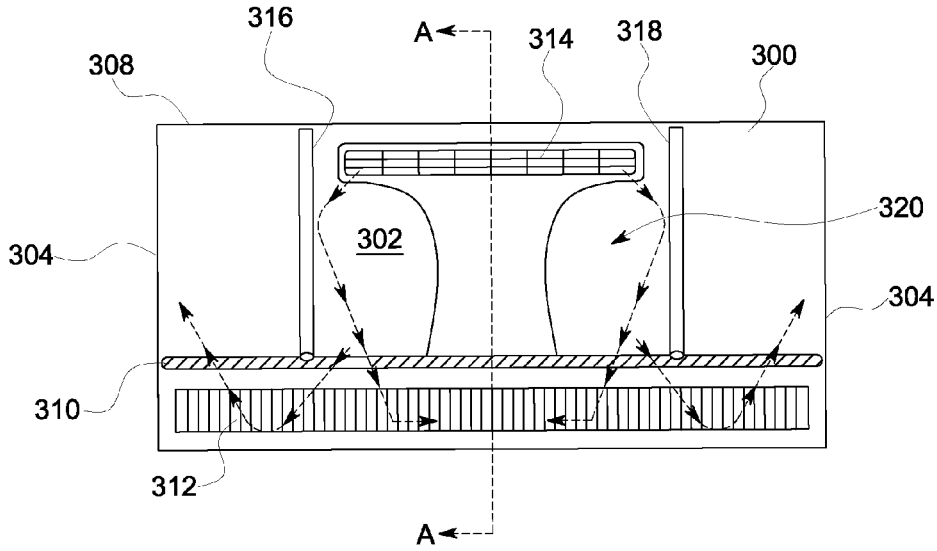
FIG. 8 is a diagram illustrating airflow in a freezer compartment with position-adjustable partitions, in accordance with one embodiment of the invention.
Figure 9:
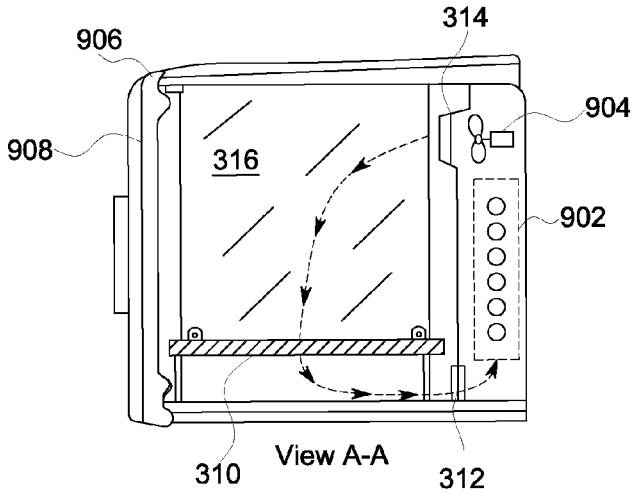
FIG. 9 is a diagram illustrating a cross-sectional view of the freezer compartment of FIG. 8 taken along line A-A.

To further explain the above-described airflow, FIG. 8 illustrates airflow in the freezer compartment 300 with position-adjustable partitions 316 and 318 in the vertical position. FIG. 9 is a diagram illustrating a cross-sectional view of the freezer compartment 300 of FIG. 8 taken along line A-A.

As described above, and as depicted by the airflow arrows shown in FIGS. 8 and 9, air cooled by the coils/tubes of an evaporator 902 is forced by a fan 904 through airflow inlet 314 into the space 320 defined by the partitions 316 and 318. The coldest air is thus substantially captured in the defined space and then exits the defined space through the (grated) shelf 310. The majority of the air, which is now less cool (warmer), then exits the freezer compartment 300 through the evaporator airflow return 312 (to be cooled again by the coils/tubes of the evaporator 902). However, a portion of the warmer air, at a lower velocity than the velocity at which it enters the compartment, is provided to the side walls 304 of the freezer compartment (as depicted by the airflow arrows). Similarly, warmer and lower velocity air is provided to those portions of the freezer door gasket 906 that contact the side walls 304 (note that the freezer door in the closed position is denoted as 908 in FIG. 9). Further, while not expressly illustrated with separate airflow arrows, warmer, lower velocity airflow can also get to the side walls and gasket areas by going around the sides of the partitions (i.e., any gaps between the partition and the rear wall and between the partition and the front wall (freezer door), if such gaps exist). As such, heat leakage in these areas (side walls and gasket) is reduced and energy efficiency of the refrigerator appliance is increased.

Also, in an alternate embodiment, one or both partitions 316 and 318 can have one or more airflow openings formed therein to allow additional airflow to the areas outside the defined space 320, i.e., to side walls 304 and door gasket areas 906. Such airflow openings could be in the form of one or more vents or holes.

Figure 10:
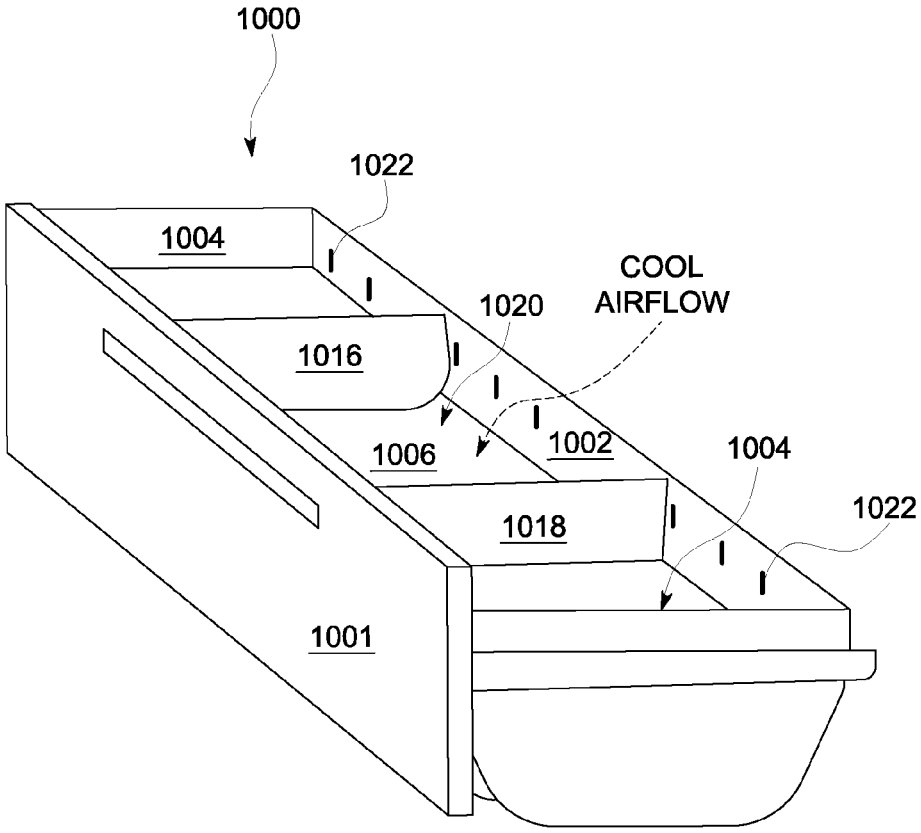
FIG. 10 is a diagram illustrating a view of a bottom-mount freezer compartment with position-adjustable partitions, in accordance with one embodiment of the invention.

FIG. 10 is a diagram illustrating a view of a bottom-mount freezer compartment 1000 with position-adjustable partitions, in accordance with one embodiment of the invention. Recall that FIG. 2 illustrates a refrigerator appliance 200 with a bottom-mount freezer compartment. Bottom-mount freezer compartment 1000 can be used in refrigerator appliance 200. It is to be understood that the freezer compartment 1000 slides out in the opened position and slides back in under the fresh food compartment in the closed position.

As shown, the generally rectangular-shaped freezer compartment 1000 is defined by a rear wall 1002, a pair of side walls 1004, floor 1006, ceiling (not shown), and front wall 1001. It is to be understood that the ceiling of the freezer compartment would be the bottom of the fresh food compartment in the bottom-mount configuration, when the freezer compartment is in the closed position.

Position-adjustable partitions 1016 and 1018 are installed in the freezer compartment 1000 via slots 1022 that are correspondingly located on the front wall 1001 and the rear wall 1002, as shown. The partitions, as in the top-mount freezer embodiment, define a space 1020. Not shown for sake of clarity are an evaporator airflow inlet and return. However, it is to be understood that the evaporator airflow inlet provides the cool airflow (depicted via airflow arrows) into the defined space 1020.

As in the top-mount freezer embodiment, the majority of the air coming from the evaporator is captured in the defined space 1020 causing a reduction in the amount of airflow that contacts one or more portions of the freezer compartment 1000 that are outside the defined space 1020. The side walls 1004 and freezer door gasket (not shown but understood to be on inside perimeter of front wall 1001) would be considered high heat leakage regions and thus would be considered portions of the freezer compartment that are outside the defined space 1020. Therefore, the majority of the coldest air entering the freezer compartment is substantially blocked by the partitions 1016 and 1018 such that warmer and lower velocity air is provided to these high heat leakage regions. If desired, partitions 1016 and 1018 could have one or more airflow openings formed therein to increase airflow to the areas outside the defined space 1020.

It is to be understood that the location and dimensions of the partitions, as illustrated and described in the context of FIGS. 3-10 above, are at least partially dependent on the location of the evaporator airflow inlet and return in the freezer compartment. Accordingly, those of ordinary skill in the art will realize modifications in locations and dimensions of the partitions given different locations of the evaporator airflow inlet and return in alternate freezer compartment configurations.

It is to be appreciated that one ordinarily skilled in the art will realize that well-known heat exchange and heat transfer principles may be applied to determine appropriate dimensions and materials of the various assemblies illustratively described herein, as well as flow rates of refrigerant that may be appropriate for various applications and operating conditions, given the inventive teachings provided herein. While methods and apparatus of the invention are not limited thereto, the skilled artisan will realize that such rates, dimensions and materials may be determined and selected in accordance with well-known heat exchange and heat transfer principles as described in R. K. Shah, "Fundamentals of Heat Exchanger Design," Wiley & Sons, 2003 and F. P. Incropera et al., "Introduction to Heat Transfer," Wiley & Sons, 2006, the disclosures of which are incorporated by reference herein.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigerator appliance comprising:

a freezer compartment;

one position-adjustable partition located in the freezer compartment, wherein the one position-adjustable partition is configured to be selectively deployed in a first position such that a space is defined in the freezer compartment that causes a reduction in an amount of inlet airflow that contacts one or more portions of the freezer compartment that are outside the defined space; and another position-adjustable partition, wherein the one position-adjustable partition and the another position-adjustable partition form a pair of partitions, and wherein when both partitions are selectively deployed in the first position, the pair of partitions defines the space.

2. The refrigerator appliance of claim 1, wherein the one or more portions of the freezer compartment that are outside the defined space comprise one or more sidewalls of the freezer compartment.

3. The refrigerator appliance of claim 1, wherein the one or more portions of the freezer compartment that are outside the defined space comprise one or more gasket portions of the freezer compartment.

4. The refrigerator appliance of claim 1, wherein the one position-adjustable partition and the another position-adjustable partition are further configured to be selectively deployed in a second position such that the amount of inlet airflow contacting the one or more portions of the freezer compartment outside the defined space is not substantially reduced.

5. The refrigerator appliance of claim 1, further comprising an evaporator airflow inlet located within the defined space.

6. The refrigerator appliance of claim 5, further comprising an evaporator airflow return located outside the defined space.

7. The refrigerator appliance of claim 6, wherein the inlet airflow enters the freezer compartment through the evaporator airflow inlet and is substantially captured in the defined space.

8. The refrigerator appliance of claim 7, wherein the inlet airflow exits the freezer compartment through the evaporator airflow return.

9. The refrigerator appliance of claim 6, further comprising a shelf, the shelf being above the evaporator airflow return and being configured to support the one position-adjustable partition.

10. The refrigerator appliance of claim 6, wherein a portion of the inlet airflow that is warmer in temperature than the temperature of the inlet airflow entering the freezer compartment, and having a lower velocity than the velocity of the inlet airflow entering the freezer compartment, is provided to the one or more portions of the freezer compartment that are outside the defined space.

11. The refrigerator appliance of claim 1, wherein the freezer compartment is a top-mount freezer compartment.

12. The refrigerator appliance of claim 1, wherein the freezer compartment is a bottom-mount freezer compartment.

13. An apparatus comprising:

one position-adjustable partition for use in a freezer compartment of a refrigerator appliance, wherein the one position-adjustable partition is configured to be selectively deployed in a first position in the freezer compartment such that a space is defined in the freezer compartment that causes a reduction in an amount of inlet airflow that contacts one or more portions of the freezer compartment that are outside the defined space; and another position-adjustable partition, wherein the one position-adjustable partition and the another position-adjustable partition form a pair of partitions, and wherein when both partitions are selectively deployed in the first position, the pair of partitions defines the space.

14. The apparatus of claim 13, wherein the one position-adjustable partition and the another position-adjustable partition are further configured to be selectively deployed in a second position in the freezer compartment such that the amount of inlet airflow contacting the one or more portions of the freezer compartment outside the defined space is not substantially reduced.

15. The apparatus of claim 13, wherein the one position-adjustable partition and the another position-adjustable partition are configured for use in a top-mount freezer compartment.

16. The apparatus of claim 13$, wherein the one position-adjustable partition and the another position-adjustable partition are configured for use in a bottom-mount freezer compartment.

17. The apparatus of claim 13, wherein the one position-adjustable partition comprises at least one airflow opening.

18. The apparatus of claim 13, wherein the one position-adjustable partition comprises at least one position holding feature.

* * * * *